United States Patent [19]

Ankenman et al.

[11] Patent Number: 4,873,508

[45] Date of Patent: Oct. 10, 1989

[54] VARIABLE RESISTANCE THERMAL PROTECTOR AND METHOD OF MAKING SAME

[75] Inventors: Bruce E. Ankenman; Donald G. Cunitz, both of Mansfield, Ohio

[73] Assignee: Therm-O-Disc, Incorporated, Mansfield, Ohio

[21] Appl. No.: 202,946

[22] Filed: Jun. 6, 1988

[51] Int. Cl.[4] ..... H01C 3/04

[52] U.S. Cl. ..... 338/25

[58] Field of Search ..... 338/25, 22 R, 225 D

[56] References Cited

U.S. PATENT DOCUMENTS

| | | | |
|---|---|---|---|
| 4,317,027 | 2/1982 | Middleman et al. | 219/548 |
| 4,463,337 | 7/1984 | Hikanson | 338/22 R |
| 4,665,377 | 5/1987 | Harpaintner | 338/195 |

*Primary Examiner*—Clifford C. Shaw
*Assistant Examiner*—M. M. Lateef
*Attorney, Agent, or Firm*—Jones, Day, Reavis & Pogue

[57] ABSTRACT

The resistance of a thermal protector is varied by forming different sizes of holes therethrough to vary the area. The external size and shape of the thermal protector remains the same for ease of fixturing and mating with other parts.

16 Claims, 1 Drawing Sheet

VARIABLE RESISTANCE THERMAL PROTECTOR AND METHOD OF MAKING SAME

BACKGROUND OF THE INVENTION

This application relates to the art of thermal protectors and, more particularly, to thermal protectors of the type that exhibit a positive temperature coefficient. The invention is particularly applicable to thermal protectors formed of a solid material capable of having holes punched therein, and will be described with specific reference thereto. However, it will be appreciated that the invention has broader aspects, and can be used with thermal protectors of other types.

Thermal protectors of the type that are formed of a material exhibiting a positive temperature coefficient have a resistance that is proportional to the conductive area. Thermal protectors having many different resistances are required for different applications. Manufacture of thermal protectors in different sizes and shapes to provide different areas and resistances makes it difficult to mate the different sizes or shapes with other standard components. The different sizes or shapes also require different fixtures to hold same for soldering or the like, or to manipulate same during assembly with other components. It would be desirable to provide thermal protectors of different resistances with the same external size and shape.

SUMMARY OF THE INVENTION

A thermal protector of the type formed of a material exhibiting a positive temperature coefficient is provided with a variable resistance by forming different sizes of holes therethrough. The holes vary the conductive area of the thermal protector, while leaving the external size and shape the same. Thus, one external size and shape of thermal protector can be manufactured, and holes of different sizes can be punched therethrough to provide a plurality of different thermal protectors having different resistance characteristics.

In a preferred arrangement, the thermal protector is a flat conductive polymer filled with conductive particles, such as carbon black. The opposite faces of the thermal protector are substantially flat and parallel to one another. A hole is formed completely through the thermal protector perpendicular to its opposite faces for varying the surface area, and thereby varying the resistance. The hole in the thermal protector is preferably centrally located, and has a circular shape.

It is a principal object of the invention to provide thermal protectors having different resistance characteristics with the same external size and shape.

It is another object of the invention to provide an improved arrangement for varying the resistance of thermal protectors.

It is a further object of the invention to provide an improved method of making thermal protectors having different resistance characteristics.

DESCRIPTION OF A PREFERRED EMBODIMENT

Figure 1:
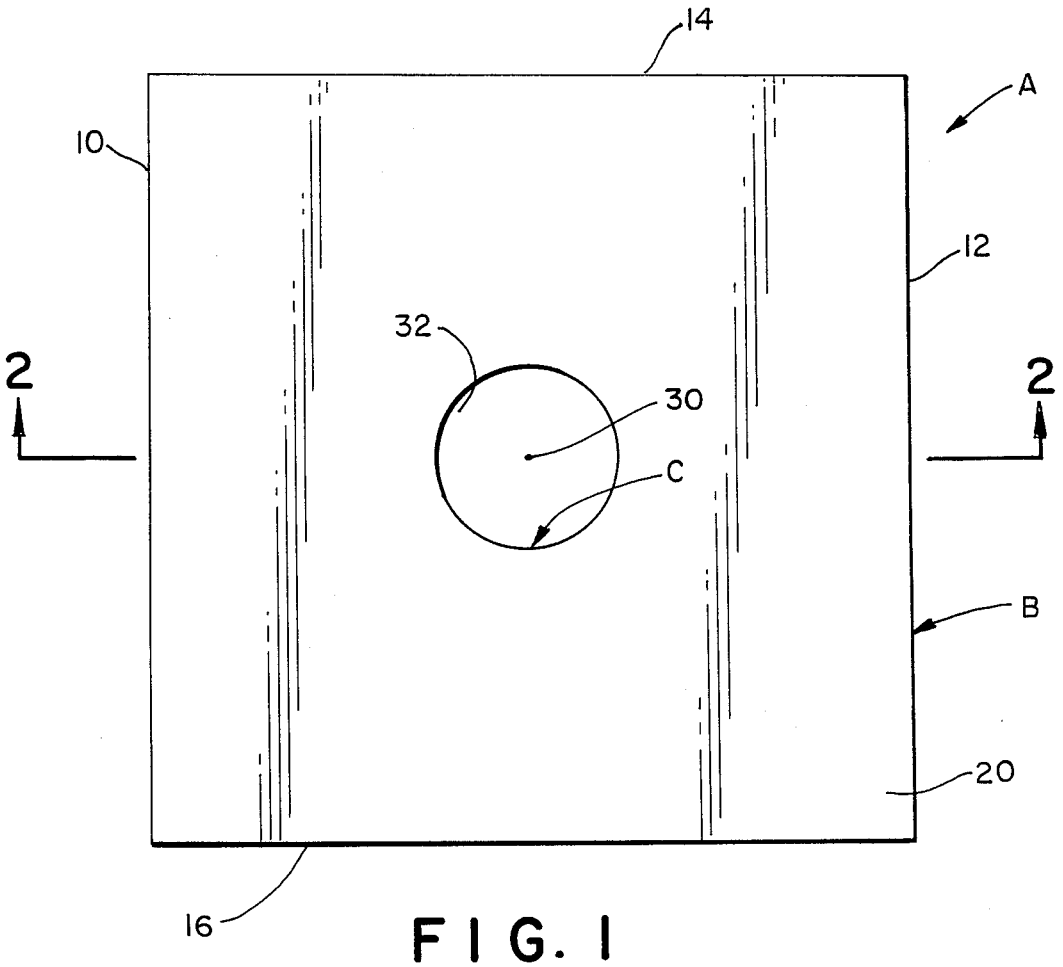
FIG. 1 is a top plan view of a thermal protector constructed in accordance with the present application.
Figure 2:
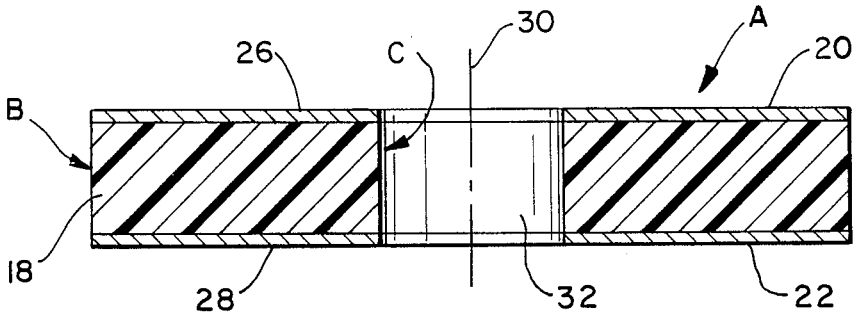
FIG. 2 is a cross-sectional elevational view taken generally on line 2—2 of FIG. 1.

Referring now to the drawing, wherein the showings are for purposes of illustrating a preferred embodiment of the invention only, and not for purposes of limiting same, FIG. 1 shows a thermal protector A of the type formed from a material exhibiting a positive temperature coefficient.

The material used to manufacture thermal protector A is preferably a conductive polymer having a particulate conductive filler, such as carbon black. However, it will be appreciated that other materials can be used for certain purposes, including a doped ceramic, such as barium titanate.

For purposes of this application, a thermal protector of the type described will be referred to as a PTC device or a PTC material. A PTC device or material exhibits a non-linear change in resistance with temperature. Within a certain narrow temperature range, the electrical resistance of a PTC device jumps sharply. A PTC device may be customized to respond to either temperature conditions of the surrounding environment or to current overload conditions. The resistance and switching temperature of a PTC device can be varied by changing its surface area. The resistance is proportional to the thickness of the PTC device divided by the PTC area. Thus, reducing the area increases the resistance.

In a typical application, a PTC device is connected in series with the circuit components requiring protection. In the event of an overload in the system, the PTC device will reach switching temperature either by self-induced heating ($I^2R$) from the current passing through it, or by sensing excessive ambient temperatures. At this point, the PTC device switches into its high resistance state, and effectively blocks the flow of current. A minimal amount of current will persist (trickle current), which holds the PTC device in its high resistance state. Once the power source has been interrupted, and the abnormal condition corrected, the PTC device will return to its rated conductive state, ready to protect the system once again.

PTC device A has an outer periphery B formed by opposite sides 10, 12 and opposite ends 14, 16 that also define length and width dimensions. In the arrangement shown, outer periphery B is substantially rectangular. However, it will be appreciated that other outer peripheral shapes are possible.

The main body portion 18 of PTC device A comprises a conductive polymer filled with conductive particles. The opposite faces of body 18 are substantially flat and parallel, and have metal foil or mesh electrodes 20, 22 bonded thereto or embedded therein. Metal foil or mesh electrodes 20, 22 may be of nickel or the like, and occupies substantially the entire area of the opposite faces of body 18. Opposite outer surfaces 26, 28 of PTC device A are substantially flat and parallel to one another. Electrical leads are connected with metal foil or mesh electrodes 20, 22, for conducting current through the thickness of body 18 perpendicular to surfaces 26, 28.

PTC device A has a longitudinal axis or center 30, and an inner periphery C defined by a hole 32 extending completely through PTC device A substantially perpendicular to opposite faces 26, 28. In the arrangement shown, hole 32 is substantially circular, and it will be appreciated that other shapes are possible. Hole 32 is also coincidental with center 30, although it will be appreciated that it could be offset in some instances. With the arrangement shown and described, PTC device A is substantially symmetrical about center 30, and between outer and inner peripheries B, C.

Forming one or more holes 32 through PTC device A reduces the area of surfaces 26, 28 and of body 18, and increases the resistance of the device. In one test, fifty PTC devices were made with a length of 0.791 inches and a width of 0.433 inches. Twenty-five of the devices had a hole of 0.187 inch diameter punched through the center thereof. The PTC devices with the hole averaged a resistance of approximately 0.0119 ohms, and the parts without the hole averaged approximately 0.0091 ohms.

The cross-sectional area of each surface 26, 28 is substantially greater than the cross-sectional area of PTC device A taken on any plane perpendicular to surfaces 26, 28 and passing through center 30. In addition, the distance between outer and inner peripheries B, C is everywhere greater than the thickness of PTC device A between opposite surfaces 26, 28 thereof. With the arrangement of the present application, outer periphery B encompasses a predetermined area, and the conductive area of PTC device A is substantially smaller than such predetermined area due to the presence of hole 32.

With the arrangement of the present application, it is possible to manufacture PTC devices having a large number of different resistances, while maintaining the same external size and shape. Therefore, the same fixtures can be used for holding all of the PTC devices to perform soldering or other assembly operations.

In a preferred arrangement, the PTC device is first manufactured in a solid configuration, and the hole is subsequently punched therethrough. However, it will be appreciated that it is possible to form the hole simultaneously with the manufacture of the PTC device. Metal foil or mesh members 20, 22 are preferably bonded to or embedded in body 18 before hole 32 is punched. Thus, the hole is also punched through the metal foil or mesh members, and such members precisely match the area of body 18. Although it is possible to form the holes in the metal foil or mesh prior to attachment thereof to body 18, it is difficult to precisely align holes in the foil or mesh with a hole in the body.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. A PTC device having inner and outer peripheries and opposite surfaces, both said inner and outer peripheries intersecting both of said opposite surfaces, electrodes on said opposite surfaces for connecting said PTC device in a circuit to carry current therethrough between said electrodes, said PTC device having a conductive area between said inner and outer peripheries that is adjustable by varying the size of said inner periphery while maintaining the size of said outer periphery.

2. The device of claim 1 wherein said electrodes have inner and outer peripheries that are substantially coincidental with said inner and outer peripheries of said PTC device.

3. The device of claim 1 wherein said inner periphery is centered within said outer periphery.

4. The device of claim 1 wherein said outer periphery is rectangular.

5. The device of claim 4 wherein said inner periphery is circular and centered within said outer periphery.

6. The device of claim 1 wherein said opposite surfaces are substantially flat and parallel to one another.

7. The device of claim 1 wherein said device has a predetermined thickness between said opposite surfaces and the distance between said inner and outer peripheries is substantially greater than said predetermined thickness.

8. The device of claim 1 wherein each of said opposite surfaces has a predetermined area that is substantially greater than he cross-sectional area of said device taken on planes extending perpendicular to said opposite surfaces through the center of said inner periphery.

9. A PTC device having opposite surfaces and an outer periphery encompassing a predetermined area, said device being conductive in a direction substantially perpendicular to said opposite surfaces and having a conductive area within said outer periphery that is smaller than said predetermined area, said conductive area being substantially uniform throughout the entire thickness of said device from one of said opposite surfaces to the other.

10. The device of claim 1 wherein said device has a center and said conductive area is substantially symmetrical about said center.

11. A PTC device having means thereon for connecting same in an electric circuit to conduct current therethrough in a predetermined direction, at least one hole through said device substantially parallel to said predetermined direction for modifying the resistance of said device by reducing the conductive area thereof throughout the entire extent thereof in said predetermined direction.

12. A method of manufacturing PTC devices of varying resistance comprising the steps of forming a PTC device having a conductivity direction and a substantially uniform predetermined area of conductivity through the entire extent thereof in said conductivity direction, and forming at least one hole through said device in said conductivity direction for reducing said area substantially uniformly through the entire extent thereof in said conductivity direction.

13. The method of claim 12 wherein said hole is formed simultaneously with formation of said device.

14. The method of claim 12 wherein said hole is formed subsequent to formation of said device.

15. The device of claim 9 including electrodes on said opposite surfaces, each of said electrodes having an area that is substantially the same as said conductive area of said PTC device.

16. The device of claim 11 wherein said means for connecting said device in an electric circuit comprises a pair of electrodes, each said electrode having a hole therethrough of substantially the same size and shape as said hole in said PTC device and being substantially coincidental therewith, each said electrode having an area that is substantially the same as said predetermined area of conductivity of said PTC device.

* * * * *